United States Patent [19]

Hanagan et al.

[11] 4,336,934

[45] Jun. 29, 1982

[54] ROWING EXERCISE MACHINE

[75] Inventors: Michael W. Hanagan, Santa Cruz, Calif.; Donald I. Schoeck, Wolcott, Conn.

[73] Assignee: Corbin Gentry, Inc., Somersville, Conn.

[21] Appl. No.: 238,807

[22] Filed: Feb. 27, 1981

[51] Int. Cl.[3] ..... A63B 69/06; A63B 21/08

[52] U.S. Cl. ..... 272/72; 272/117; 272/134

[58] Field of Search ..... 272/72, 93, 116 R, 117, 272/118, 130, 134, 125; D21/191, 195, 196

[56] References Cited

U.S. PATENT DOCUMENTS

| | | | |
|---|---|---|---|
| 458,382 | 8/1891 | Zander | 272/117 |
| 2,921,791 | 1/1960 | Berne | 272/117 X |
| 3,000,632 | 9/1961 | Fuchs | 272/117 |
| 3,112,108 | 11/1963 | Hanke | 272/72 X |
| 3,120,954 | 2/1964 | Apostol | 272/117 |
| 3,558,101 | 6/1971 | Jungreis | 272/117 |
| 3,558,130 | 1/1971 | Anderson | 272/72 |
| 3,708,167 | 1/1973 | Potgieter | 272/117 |
| 3,731,922 | 5/1973 | Jungreis | 272/117 |
| 3,850,430 | 11/1974 | Hamilton | 272/117 |
| 4,226,414 | 10/1980 | Coffaro et al. | 272/117 |

FOREIGN PATENT DOCUMENTS

| | | | |
|---|---|---|---|
| 497059 | 5/1930 | Fed. Rep. of Germany | 272/134 |
| 457018 | 7/1913 | France | 272/134 |

OTHER PUBLICATIONS

Marcy Gym Equipment Co., Physical Fitness Equipment Catalog No. 69, 1968, p. 22, "Deluxe Calf and Hacke", Machine, Glendale, Calif.

*Primary Examiner*—Richard J. Apley
*Assistant Examiner*—Arnold W. Kramer

[57] ABSTRACT

A rowing exercise machine has a frame including a base portion and an upstanding portion. A seat is mounted intermediate the ends of the upstanding portion on the rearward side and a chest support is mounted thereabove. An upstanding effort arm is pivotally attached adjacent its lower end to the base portion of the frame at a location spaced forwardly of the upstanding portion. A handle member has a forward end pivotally attached adjacent the upper end of the effort arm and extends generally rearwardly towards the chest support. A weight bar is pivotally attached adjacent its rearward end to the upstanding portion of the frame and extends forwardly beyond the effort arm with a mount for weights adjacent its forward end. A tie rod is pivotally attached adjacent one end intermediate the effort arm and pivotally attached adjacent its other end proximate the rearward end of the weight bar. The weight bar is disposed at rest generally in a horizontal attitude and is elevated toward a generally vertical attitude by the exertion of a force rearwardly on the handle member as in rowing. A foot operated treadle linked to a pivotal stand can pivot the stand to support an engagement member depending from the weight bar to support the weight bar in its generally horizontal at rest position.

11 Claims, 5 Drawing Figures

ROWING EXERCISE MACHINE

BACKGROUND OF THE INVENTION

To provide maximum benefit, an exercise machine should be designed not only to work specific muscle groups, but also to present a variable load that changes in proportion to the positionally related strength capability of the muscles being exercised. For example, it is now recognized that, in a rowing movement, the force capability of the normal subject will vary non-linearly from a maximum value, when the arms are fully extended, to a minimum value when they are withdrawn to a position close to his chest. Accordingly, it is desirable that any machine intended for the performance of such exercises be capable of offering a variable resistance that is closely correlated to the strength/position capacity of the involved muscle group.

In terms of absolute strength, it is also recognized that the range of normal capability is rather broad, and that some individuals are able to exert relatively high levels of force in such an exercise. Consequently, if the machine is to have widespread utility, it must, as a practical matter, be capable of multiplying the load of the attached weights. In addition, it is important that the machine operate smoothly and with a minimum amount of friction; otherwise, the purity or integrity of the exercise will be compromised by the introduction of spurious resistances, and the equipment will be subjected to excessive wear and inadequate durability.

Again, in more specific terms, a row machine will advantageously have the capacity of working all muscle groups through the back and shoulders, concentrating on the anterior deltoid, infraspinatus, rhomboideus, teres minor, teres major, latissimus dorsi and trapezius muscles. To do so, not only must the rowing motion be sufficiently sophisticated to kinesiologically correlate to the exercise, but the equipment must also accommodate gripping by the individual in different hand and arm positions, so as to effectively stress the various muscle groups. It is, of course, also of utmost importance that the equipment not cause undue stress upon vulnerable parts of the body, such as would create a risk of injury to the subject. As far as is known, no exercise machine heretofore described or provided offers the foregoing features and advantages.

Accordingly, it is a primary object of the present invention to provide a novel row machine, which presents a resistance to the subject that varies non-linearly throughout the range of movement that occurs during the exercise, and which is correlated to the normal strength-to-position relationship of the muscle groups involved.

It is also an object of the invention to provide such a machine which is effective to provide maximum exercise efficiency while avoiding overloading or underloading at any particular point during the range of movement involved in the exercise.

Another object of the invention is to provide such a novel machine which operates smoothly and with a minimum amount of friction, thereby affording maximum purity in the exercise while ensuring that the equipment will retain a high level of functional quality throughout a relatively long useful life.

Yet another object of the invention is to provide a machine having the foregoing advantages and features, in which the resistance offered is a multiple of the applied weight, to permit use by individuals representing a wide range of strength capabilities.

A further object of the invention is to provide a rowing exercise machine in which the subject is advantageously positioned for maximum benefit, while being protected against undue strain and injury, particularly to his lower back region.

A still further object of the invention is to provide a machine of the foregoing nature, in which various gripping positions are conveniently assumed, to thereby enable its use in exercising the various muscle groups of the back and shoulders.

SUMMARY OF THE INVENTION

It has now been found that the foregoing and related objects of the invention are readily attained in a row machine comprising a frame, including a base portion and an upstanding portion, and subject-positioning means on the upstanding portion of the frame. An upstanding effort arm is pivotably attached adjacent its lower end to the base portion of the frame, at a location spaced forwardly of the subject-positioning means, and a handle member has its forward end portion pivotably attached adjacent the upper end of the effort arm, and extending generally rearwardly toward the subject-positioning means. The machine also includes a weight bar that is pivotably attached adjacent its rearward end to the upstanding portion of the frame, at a location spaced above the base portion thereof; the weight bar extends forwardly beyond the effort arm, and has means adjacent its forward end to permit weights to be mounted thereon. A tie rod is pivotably attached adjacent one end to the effort arm, at a location between the upper and lower ends of the latter, and is pivotably attached adjacent its opposite end to the weight bar, at a location between its rearward and forward ends. The weight bar is disposed, at rest, in a generally horizontal attitude, with the handle member extended forwardly; it may be elevated toward a generally vertical attitude by the exertion of force rearwardly upon the handle member, toward the subject-positioning means.

In more specific embodiments, a seat is mounted on the upstanding portion of the frame, to at least in part provide the subject-positioning means of the machine, and the handle member is positioned to operate generally in a plane disposed above the normal seat level. Preferably, the subject-positioning means will comprise a chest support in addition to the seat, which is rigidly affixed thereabove and generally perpendicular to, and at about the level of, the plane of operation of the handle member, to thereby limit the forward position of the seated subject by chest contact and restraint. The location of weight bar attachment will generally be below seat level.

Again in more particular terms, the upstanding portion of the frame may include a generally vertical column, and a brace assembly extending generally diagonally between the column and the base portion of the frame, adjacent the lower end of the effort arm, and carrying means for pivotably attaching the weight bar thereto. To provide the desired mechanical relationships, the "one" end of the tie rod will generally be attached approximately midway between the ends of the effort arm, and the "opposite" end thereof will be attached in a position that is proximate to the inner end of the weight bar.

In especially desirable embodiments, the handle member will include vertically and horizontally disposed gripping portions. It may comprise a shaft portion and a pair of horizontally disposed handle portions extending from the inner end thereof, toward the subject-positioning means. The handle portions will desirably be configured to extend divergently and then convergently, to provide elongated gripping sections, normally disposed forwardly of the subject-positioning means.

Finally, the machine will most desirably additionally include means for disengageably supporting the weight bar in its at rest attitude, and such supporting means may comprise an engagement member depending from the weight bar, and a stand pivotably attached to the frame beneath the weight bar for movement between disengaged and engaged positions. The engagement member of the weight bar is adapted to be received in the underlying stand in the engaged position to prevent its further movement in a downward direction, thereby facilitating gripping of the handle member from an exercising position. The disengageable supporting means may additionally include means for shifting the stand between the engaged and disengaged positions, which shifting means may comprise linkage to the stand and a treadle disposed for foot operation by the subject.

DETAILED DESCRIPTION OF THE ILLUSTRATED EMBODIMENT

Figure 1:
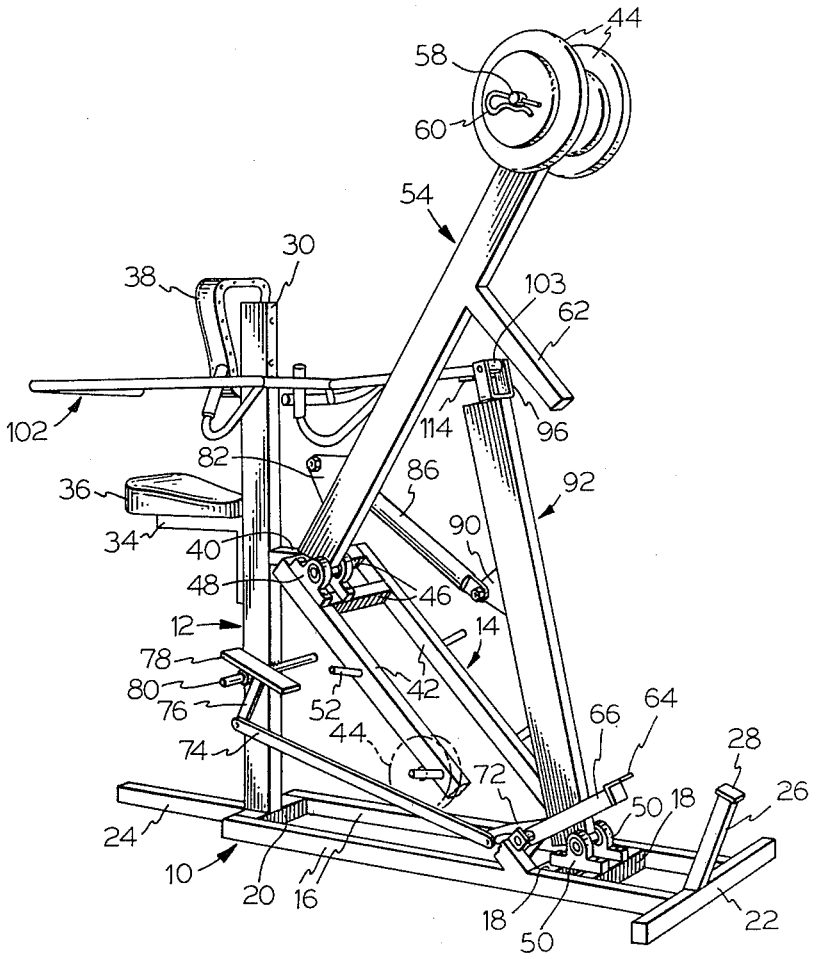
FIG. 1 is a perspective view of a machine embodying the present invention.

Turning now in detail to FIGS. 1 and 3 through 5 of the appended drawings, therein illustrated is an exercise machine embodying the present invention, and consisting of a frame base portion, generally designated by the numeral 10, an upstanding post member, generally designated by the numeral 12, and a diagonal brace assembly, generally designated by the numeral 14. The frame base portion 10 consists of a pair of longitudinally extending parallel bars 16, and short connecting brace pieces 18, 20 extending therebetween. At the forward end of the base portion 10 is a relatively long transverse foot member 22 affixed across the bars 16 and having portions extending outwardly thereof, to provide lateral stability to the machine; a longitudinal foot member 24 extends rearwardly from the piece 20 to support the machine against tipping backwardly. A short post 26 projects upwardly and slightly forwardly from the transverse foot 22, and has a small platform 28 mounted on its upper end, which serves as a stop for the weight bar, as will be discussed in detail below.

The post member 12 consists of a column 30, having its lower end attached to the connecting piece 20, and having an L-shaped bracket 32 with a rearwardly extending leg 34, mounted thereon at a level intermediate its ends. The bracket leg 34 has a seat 36 secured thereto, and generally the bracket will be of adjustable height, such as by the provision of telescoping members that can be locked at any of several levels by inserting a pin through alignable apertures in the respective parts, as is conventional. Adjacent the upper end of the column 30 is secured a padded chest support 38, which is positioned relative to the seat 36 so as to engage the chest of the seated individual, to restrain and limit his forward movement. A short, forwardly extending connecting bar 40 is affixed to the column 30 at a point just below the seat 36, and it serves to connect the diagonal brace assembly 14 thereto. The latter consists of a pair of parallel, diagonally oriented struts 42, joined by transverse pieces 46 and affixed at their lower ends to the elongated bars 16 of the frame base portion 10. Matched sets of bearing blocks 48,50 are secured between the pieces 46,18 respectively, and short posts 52 are affixed angularly on the struts 42, to provide storage places for the weights to be used with the machine.

Journalled in the upper bearing blocks 48 is a weight bar, generally designated by the numeral 54, which has a pivot rod 56 affixed to its rearmost end for that purpose. The forward end of the bar 54 carries a transverse weight-mounting shaft 58, which has small unnumbered apertures at its opposite ends to receive retaining pins 60 (only one of which is visible). As is evident, the weights 44 are mounted on the ends of the shaft 58 in a conventional manner.

A support leg 62 projects downwardly from the bar 54 at a slight inward angle, and it has a lower end which is adapted to be engaged within the seat portion 64 of a supporting member or stand 66. The stand 66 s pivotably engaged upon a transversely extending pivot bar 68, which is attached to the bracket assembly 14, and it has a relatively straight finger portion 70 extending in front of the transverse stop bar 71 (best seen in FIG. 3), and a curved finger portion 72 extending therebehind. Pivotably attached to the outer end of the finger portion 72 is a tie bar 74, which is similarly attached at its opposite end to the depending arm portion 76 of a treadle member 78, which in turn is pivotably supported upon the footrest bar 80 affixed to the column 30. The stand 66 serves to support the weight bar 54 in its rest position, with the leg 62 received in the seat portion 64. Elevation of the weight bar 54 will release the leg 62, and will permit the stand 66 to be shifted (manually or under its own weight) to pivot to the forward position shown in in FIG. 3 (in phantom line) and in FIG. 1, with the finger 72 resting upon the stop bar 71. To reestablish the rest position, it is merely necessary to elevate the stand 66 by operation of the treadle 78 to the point of engagement of the other finger 70 with the stop 71, and to position the weight bar 54 so as to seat the leg 62 on the seat portion 64.

An upwardly projecting flange 82 is affixed to the top edge of the weight bar 54, and one end of a tie rod 86 is pivotably attached (such as by a nut and bolt) thereto; the opposite end of the rod 86 is similarly bolted to the flange 90, which is affixed at the inner edge of the effort arm, generally designated by the numeral 92. A short transverse axle 94 is joined to the lower end of the effort arm 92, and is journaled in the bearings 50 which are attached to the brace pieces 18, thus permitting low friction pivotable movement thereabout. The upper end of the effort arm 92 carries a bracket 96 which, in turn, receives a bolt, by which is secured thereto the tubular shaft 100 of the handle member, generally designated by the numeral 102.

Figure 5:
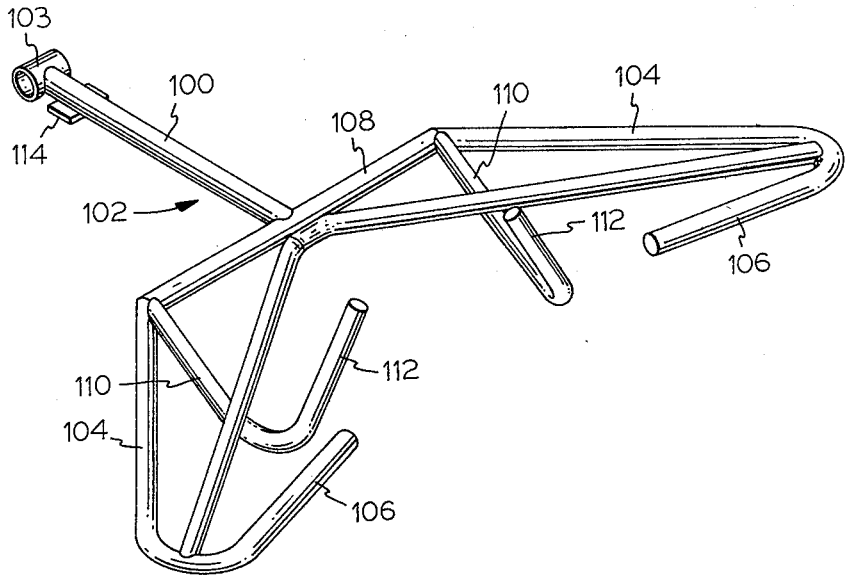
FIG. 5 is a perspective view of the handle member used in the machine of the foregoing figures, drawn to a further enlarged scale.

As is best seen in FIG. 5, the handle member 12 has a short cylindrical sleeve element 103 on the forward end of the shaft 100 for connection to the effort arm bracket 96, and it has mirror-image lateral portions 104, which diverge and then converge toward one another to provide generally horizontal gripping sections 106. Affixed at each of the two joints between the lateral portions 104 and the crosspiece 108, by which they are attached to the shaft portion 100, is a V-shaped portion 110, which extends downwardly and then upwardly, to provide generally vertical gripping sections 112 thereon; as can be seen, the sections 112 are inclined toward one another. This configuration of the handle member 102 permits gripping with the hands oriented in either a vertical or horizontal attitude, and it furthermore enables gripping with the hands spaced different distances apart, by grasping either of the pairs of gripping sections 106,112 at appropriate points along their length. The small plate 114 adjacent the sleeve 103 functions in cooperation with the bracket 96 to maintain the handle in a conveniently elevated position.

Figure 4:
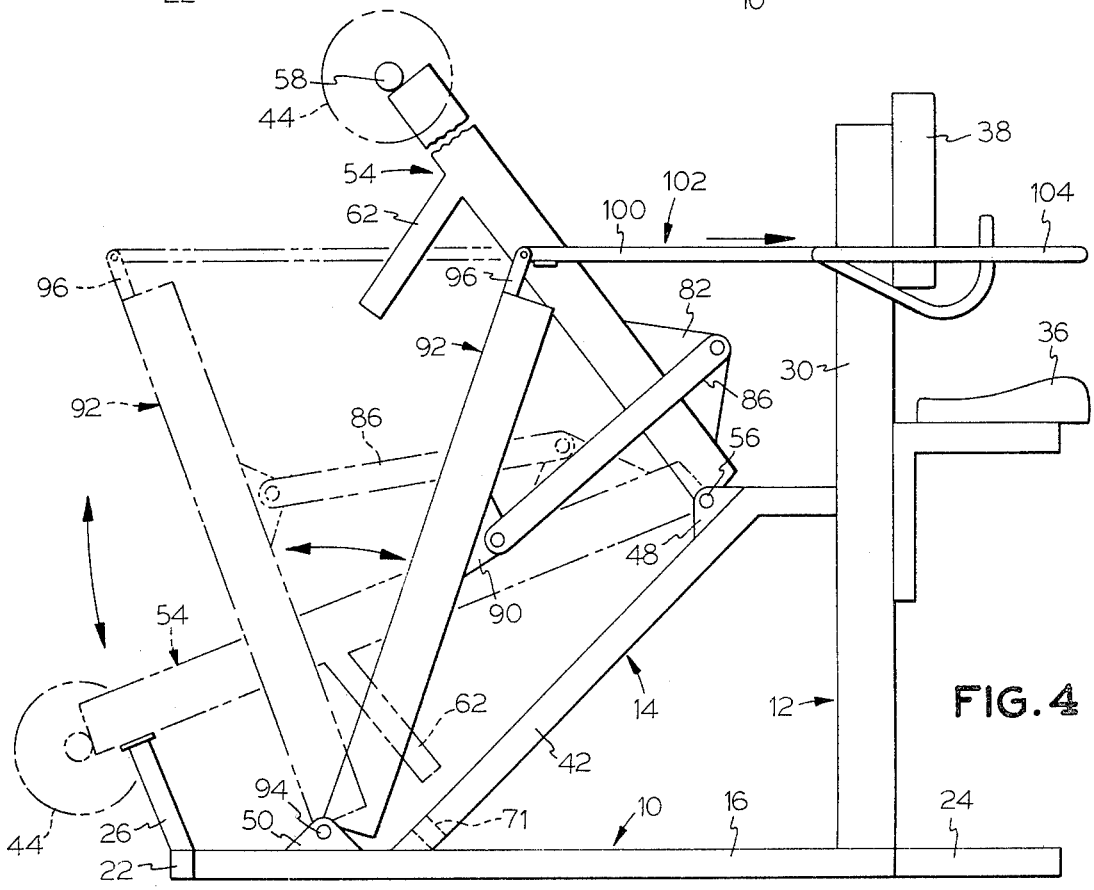
FIG. 4 is a view comparable to FIG. 3, showing in full line and phantom line the machine in the handle-retracted and handle-extended positions, respectively.

To operate the machine (normally from the rest position shown in FIG. 3), the individual places himself on the seat 36, positions his chest against the chest support 38, and extends his arms to grasp the handle 102. He then pulls rearwardly on the handle 102, thus releasing the weight bar 54 from the stand 66 and elevating it toward the more vertical position shown in FIG. 4 in full line. Repetitious inward and outward movement of the handle 102 will constitute the normal exercise motion. The phantom line representation of FIG. 4 shows the weight bar 54 at its lowest extreme, in abutment against the platform 28; this position will not normally be achieved during the exercise cycle, depending of course upon the reach of the individual performing the exercise. The normal arc of movement of the weight bar 54 will typically be from about 30° below to about 45° above horizontal, although this will again depend upon the subject as well as upon the design of the particular equipment in question. As noted previously, when the exercise is completed, the weight bar 54 will be held in an appropriate position to permit its depending leg 62 to be lowered onto the seat portion 64 of the stand 66, which will be brought into proper registration therewith by manipulation of the foot treadle 78.

Figure 2:
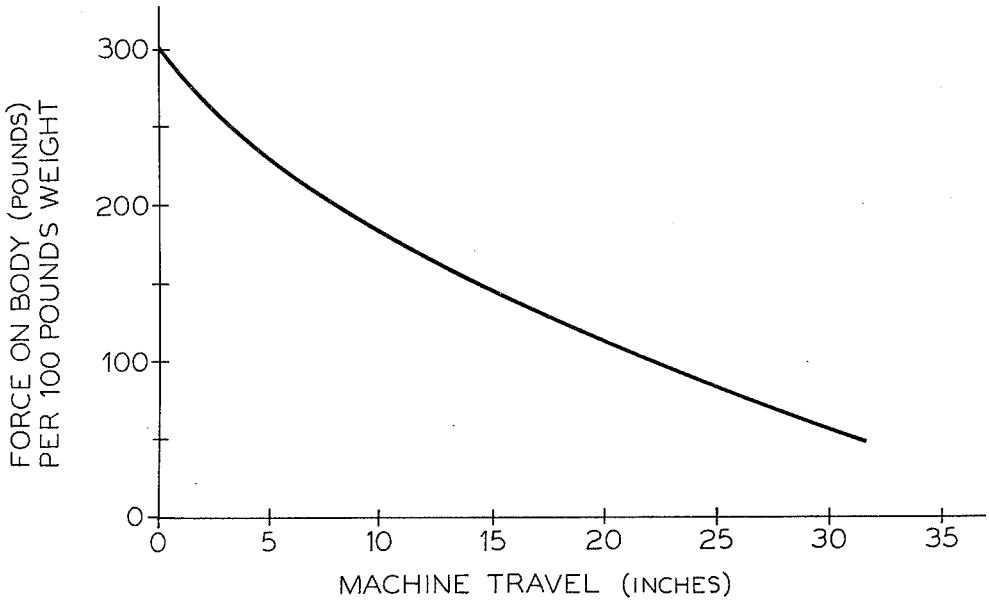
FIG. 2 is a graph showing the relationship of load resistance to handle position, that is characteristic of the machine of FIG. 1.
Figure 3:
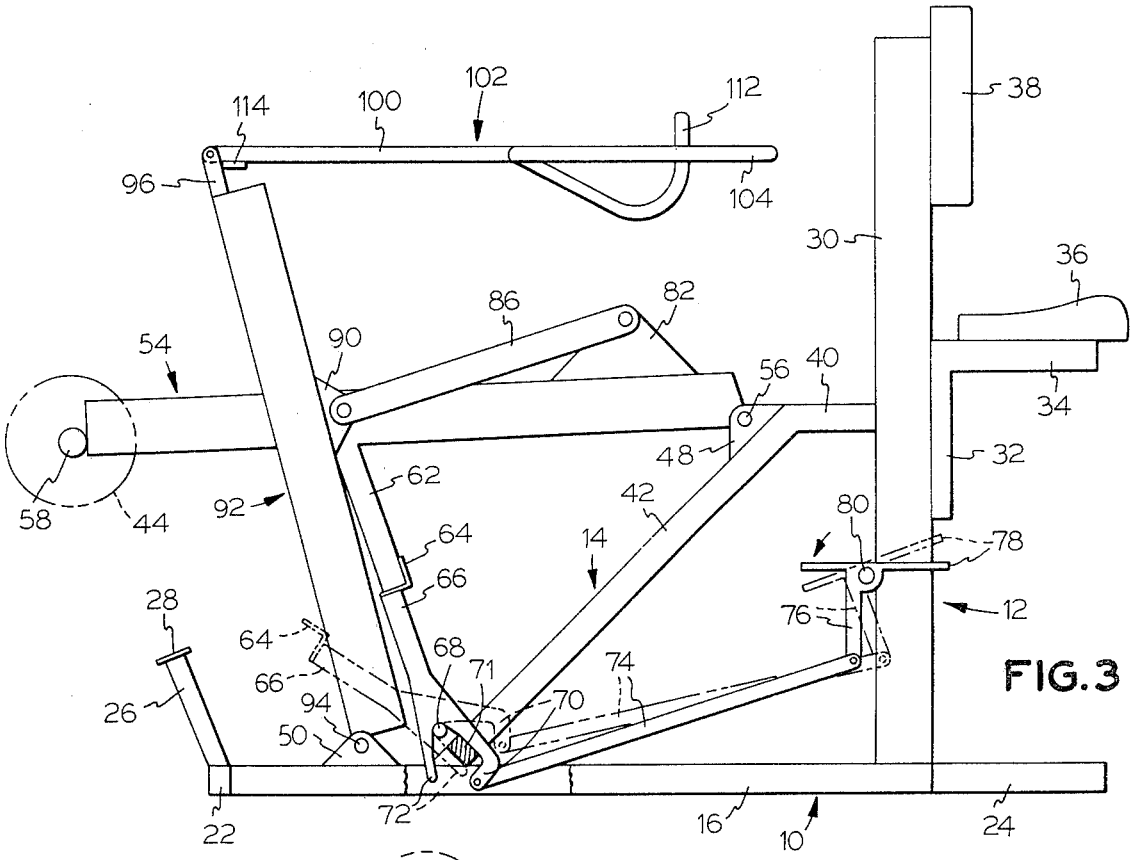
FIG. 3 is a side elevational schematic representation of the machine of FIG. 1 in its at rest position, drawn to an enlarged scale and showing, in phantom line, the weight bar supporting stand in its disengaged condition.

The curve that is shown in FIG. 2 graphically illustrates the effective variation in loading that occurs in the course of moving the handle member 102 through its normal stroke during performance of the exercise. Plotted on the "Y" axis is the value of the force (in pounds), or the level of resistance, presented to the subject, per 100 pounds of weight that is mounted on the weight bar. As can be seen, that value varies depending upon the displacement (in inches) of the handle from its fully forward position; this distance is plotted on the "X" axis of the graph. It is to be noted that the effective loading varies in a non-linear manner, and survey data indicate that the curve shown correlates closely to the capability of normal individuals to exert force in the various positions attained throughout the range of movement involved in the exercise. Thus, with the arms fully extended, the normal subject is capable of maximum pulling power, and his strength diminishes to a minimum level when his hands and arms are withdrawn closely to his chest. It is also to be noted that the machine is capable of multiplying the weight applied to the weight arm, the effective resistance being approximately a three-fold increase, at the point of intended commencement of the exercise. It is also to be noted that, while the rest position of the weight bar will be approximately horizontal, considerable deviation may exist with no detriment to the functioning of the machine. The actual position will generally represent a compromise between convenient positioning of the handle member for initial grasping, and minimization of the height to which the weights must be lifted for loading.

To provide a perhaps more complete appreciation for the mechanical relationships that will produce the desired effects in a machine of the present type, typical dimensions may be indicated. However, it is to be understood that these dimensions are provided only for illustrative purposes, and are not intended to be limiting upon the broad concepts of the invention. More particularly, the weight bar 54 may have an overall length of about 48 inches; the pivotal axis through the flange 82 may be located about 11 inches from the inner end of the bar, and about 7 inches above its centerline. The tie rod 86 may measure about 22 inches between its axes of pivoting, and the axis through the flange 90 on the effort arm 92 may be about 5 inches from the centerline of that member and about 24 inches above its lower end; the arm itself may be about 43 inches long, between pivot points. The axes of pivoting through the bearing blocks 48 and 50 may be separated horizontally from one another by about 28 inches, and vertically by about 24 inches. Finally, the median position of the seat 36 may be approximately 5 inches above the pivotal axis of the bearings 48, and the chest support 40 may be about 18 inches therefrom, measured horizontally. While the foregoing exemplary dimensions are not critical, the relationships indicated do provide optimal benefits in terms of efficient exercising of the involved muscle groups.

The chest support 40 serves the important function of isolating the muscle groups that are to be exercised, to thereby ensure maximum benefit thereto while protecting other muscle groups of the body against undue strain. In particular, the small of the back may be particularly susceptible to strain in an exercise of this nature, and the chest support 40 is effective in protecting that region against injury.

As will be appreciated by those skilled in the art, the machine of the present invention will ideally employ bearings and associated parts that reduce friction to a minimum value. It will also be recognized that the present machine employs no pulleys, cables, cams or like elements, thereby avoiding undesirable consequences which result from their use, such as excessive friction, roughness of operation, reduced durability, and noisy operation.

Thus, it can be seen that the present invention provides a novel row machine, which presents a resistance to the subject that varies non-linearly throughout the range of movement entailed, and which is correlated to the normal strength-to-position capability of the muscle groups involved. The machine provides maximum exercise efficiency, while avoiding overloading or underloading at any particular point, and it operates smoothly and with a minimum amount of friction, thereby affording purity in the exercise while ensuring that a high level of functional quality will be maintained in the equipment throughout a relatively long useful life. The resistance offered by the machine is a multiple of the applied weight, thereby permitting its use by individuals representing a wide range of strength capabilities, and the subject is advantageously positioned therein for maximum benefit and minimum risk of strain and injury. By permitting the operating handle to be gripped in different positions, the machine is also adapted to enable exercise of the various muscle groups of the back and shoulders.

Having thus described the invention, what is claimed is:

1. A rowing exercise machine comprising in combination:

a frame, including a base portion and an upstanding portion;

subject positioning means to said upstanding portion of said frame;

an upstanding effort arm pivotably attached adjacent its lower end to said base portion of said frame at a location spaced forwardly of said subject positioning means;

a handle member having a forward end portion pivotably attached adjacent the upper end of said effort arm and extending generally rearwardly toward said subject positioning means;

a weight bar pivotably attached adjacent its rearward end to said upstanding portion of said frame at a location spaced above said base portion thereof, extending forwardly beyond said effort arm and having means adjacent its forward end for mounting weights thereon; and a tie rod pivotably attached adjacent one end to said effort arm at a location between said upper and lower ends thereof, and pivotably attached adjacent its opposite end to said weight bar at a location between said rearward and forward ends thereof, said weight bar being disposed at rest in a generally horizontal attitude, and being elevated toward a generally vertical attitude by the exertion of force rearwardly upon said handle member to pivot said effort arm toward said subject positioning means.

2. The machine of claim 1 wherein a seat is mounted on said upstanding portion of said frame to at least in part provide said subject positioning means, said handle member being positioned to operate generally in a plane disposed above the normal level of said seat.

3. The machine of claim 2 wherein said location of weight bar attachment is below the normal level of said seat.

4. The machine of claim 2 wherein said subject positioning means additionally comprises a chest support mounted on said upstanding portion of said frame, said chest support being affixed generally forwardly and above said seat, and generally perpendicular to, and at about the level of said plane of handle member operation, to limit the forward position of the seated subject by chest contact and restraint.

5. The machine of claim 1 wherein said upstanding portion of said frame incudes a generally vertical post, and a brace assembly extending generally diagonally between said post and said base portion of said frame adjacent said lower end of said effort arm, said brace assembly including means for pivotably attaching said weight bar to said upstanding frame portion.

6. The machine of claim 1 wherein said locations of attachment of said one end of said tie rod is approximately midway between said upper and lower ends of said effort arm, and of said opposite end thereof is proximate said rearward end of said weight bar.

7. The machine of claim 1 wherein said handle member includes vertically disposed sections and horizontally disposed sections for gripping by the subject.

8. The machine of claim 1, wherein said handle member comprises a shaft portion at said forward end portion thereof, and a pair of horizontally disposed handle portions extending rearwardly from said shaft portion generally toward said subject positioning means, said handle portions extending divergently and then convergently to provide elongated, gripping sections normally disposed forwardly of said positioning means.

9. The machine of claim 1 additionally including means for disengageably supporting said weight bar in said at rest attitude thereof.

10. The machine of claim 9 wherein said disengageable supporting means comprises an engagement member depending from said weight bar, and a stand pivotably attached to said frame beneath said weight bar for movement between disengaged and engaged positions, said enagement member of said weight bar being received in said underlying stand in said engaged position, to thereby prevent its further movement in a downward direction.

11. The machine of claim 10 wherein said disengageable supporting means additionally includes means for shifting said stand between said engaged and disengaged positions, said shifting means comprising linkage connected to said stand means, and a treadle disposed for foot operation by the subject.

* * * * *